US006464223B2

(12) United States Patent
Rutter

(10) Patent No.: US 6,464,223 B2
(45) Date of Patent: Oct. 15, 2002

(54) RACE VEHICLE GAME

(76) Inventor: John R. Rutter, 31535 Cambridge, Garden City, MI (US) 48135

( * ) Notice: Subject to any disclaimer, the term of this patent is extended or adjusted under 35 U.S.C. 154(b) by 0 days.

(21) Appl. No.: 09/873,887

(22) Filed: Jun. 4, 2001

(65) Prior Publication Data

US 2002/0020964 A1 Feb. 21, 2002

Related U.S. Application Data

(60) Provisional application No. 60/216,240, filed on Jul. 6, 2000.

(51) Int. Cl.[7] ..... A63F 3/00

(52) U.S. Cl. ..... 273/246; 273/248; 273/259; 273/277

(58) Field of Search ..... 273/243, 244, 273/246, 259, 277, 248

(56) References Cited

U.S. PATENT DOCUMENTS 1,628,073 A 5/1927 Sousa
5,114,152 A * 5/1992 Rouse et al. ..... 273/246
5,139,267 A * 8/1992 Trevisan ..... 273/246
5,228,699 A 7/1993 Ludwick et al.
5,308,078 A * 5/1994 Hatter ..... 273/246
5,322,293 A * 6/1994 Goyette ..... 273/246
5,350,178 A * 9/1994 Hollar ..... 273/246
5,551,698 A * 9/1996 Lyon ..... 273/246
5,749,582 A * 5/1998 Fritz et al. ..... 273/246
5,934,673 A * 8/1999 Telarico et al. ..... 273/246
6,095,522 A * 8/2000 Spell et al. ..... 273/246

* cited by examiner

*Primary Examiner*—Benjamin H. Layno
*Assistant Examiner*—Vishu K Mendiratta
(74) *Attorney, Agent, or Firm*—MacMillan, Sobanski & Todd, LLC

(57) ABSTRACT

A vehicle racing board game includes a racetrack having a start/finish line crossed by lanes and a pit area connected to the lanes. The lanes and the pit area are divided into a plurality of spaces including starting positions and a crash zone. Toy vehicles are used as playing pieces for advancing around the racetrack according to numbers generated by dice. The dice also are used to determine starting positions that set the order of play and identify a "crash". Points are awarded for winning the pole position, winning a lap and finishing position in each race of a season to determine a champion.

2 Claims, 3 Drawing Sheets

RACE VEHICLE GAME

This application claims priority from Provisional application Ser. No. 60/216,240, filed Jul. 6, 2000.

BACKGROUND OF THE INVENTION

This invention relates in general to board games and, in particular, to a game for toy vehicles such as cars and trucks and to a game board used to play the game.

Board games are well known. Some board games have provided intellectual stimulation, such as Scrabble® and Trivial Pursuit®, by supplying questions to answer or words to form from a given set of letters. The person who correctly answered the most questions or formed the most words in the shortest amount of time generally was declared the winner. Other board games, such as "Monopoly®", which imitated real estate acquisition in Atlantic City, N.J., attempted to simulate real-life circumstances. Still other board games have attempted to simulate sporting events, including football, baseball, and basketball. Board games, regardless of whether they simulate real-life circumstances, provide intellectual stimulation, or simulate a sporting event, typically utilize a game board, game pieces, chance devices, such as dice or a shuffled deck of cards, and a means for recording a player's score.

Automobile racing, most notably the National Association for Stock Car Auto Racing (NASCAR) racing circuit, has seen a large increase in popularity in recent years. An increasing number of races per year, rising attendance and national broadcasts on radio and network television, have all contributed to the booming popularity of the sport. "Open-wheeled" racing, including Formula One (F-1), the Championship Auto Racing Teams (CART) and the Indy Racing League (IRL) racing circuits, also continues to be popular. As the popularity of auto racing has increased, numerous board games have emerged attempting to simulate the thrill and excitement of an automobile race. These games generally consist of a game board laid out in the shape of a racetrack, game pieces in the shape of racecars, a means for the players to move the game pieces around the racetrack, and a means for scorekeeping.

The U.S. Pat. No. 5,934,673 discloses an auto racing board game with a game board laid out in the shape of a racetrack and game pieces in the shape of automobiles. The game board is divided into lanes that simulate positions on a racetrack. Players advance around the track by drawing cards from a shuffled deck. The cards make provisions for actual racing conditions including good handling, contact with other racecars and, of course, racecar crashes.

The U.S. Pat. No. 6,095,522 discloses a stock car racing board game with a game board laid out in the shape of a "tri-oval" race track, which is also divided into lanes, and tokens that represent racecars. Players advance around the track by rolling dice. In addition, cards from a shuffled deck are utilized to simulate mechanical problems, and the lanes are divided into 'drafting' lanes, where the actual drafting technique of racecar drivers is simulated to allow cars trailing other cars to draw nearer to the leading cars.

While the above examples of prior art all relate to board games that simulate automobile racing, the above examples require a good deal of familiarity with the intricacies of automobile racing and associated mechanical failures and conditions of the racecars. In addition, the prior art does not teach a board game designed for simulating a race season. While the prior art could possibly be adapted to simulate a race season, the myriad of rules and specific mechanical problems provided for in the prior art are not conducive to producing quick games to simulate an entire racing season.

It is desirable, especially for children, to provide a board game that is easy to learn and understand. It is also desirable to provide a board game where an entire racing season may be simulated in a manner that is rapid and easy while keeping the individual races interesting to the players. It is desirable to provide a game with quick and exciting action that does not get mired in the minutiae of racing strategy or the various mechanical problems and failures that are possible in an actual racecar. It is also desirable, though, in order to appeal to those with more knowledge of automobile racing, to provide a board game that does present some degree of realism by simulating some of the more familiar features of an actual automobile race.

It is an object of the present invention, therefore, to provide an automobile racing board game that is exciting but also easy to learn and play, especially for children.

It is another object of the invention to provide an automobile racing board game that simulates a racing season, by allowing players to race a set of races in order for a winner to be determined after the last of the set of races.

It is still another object of the invention to provide a board game that simulates an automobile race that is quick and easy to play, yet also provides some details for those familiar with automobile racing.

It is yet another object of the invention to provide an automobile racing board game that may be utilized with toy vehicles already in possession of the players.

SUMMARY OF THE INVENTION

The present invention concerns a game for entertainment that uses toy vehicles on a racetrack. The racetrack is printed on a game board that can be folded and easily stored. The game includes the game board, a twenty-sided die, a twelve-sided die, a six-sided die, and markers (for identifying name and lap). The game optionally includes the toy race vehicles. Numerous variations of the game and game board can be contemplated.

The present invention allows players to enjoy the thrill and excitement of an automobile race and a racing season, but does not require detailed knowledge of actual racing strategy or mechanical failures of racecars. The present invention does, however, provide some of the particulars that are encountered in an actual automobile race. The racetrack printed on the foldable game board is preferably divided into at least three lanes. The racetrack contains both straight sections ("straightaways") and curved sections ("curves".) The racetrack lanes are further divided into spaces for the toy race vehicles and simulate an actual racetrack by providing additional spaces in the outermost lanes, thereby giving an advantage to those players situated in the inside lane.

In order to begin play, players twice roll all the dice in order to determine the pole, or starting point positions for their respective toy vehicles. The player with the highest roll total will become the pole leader; the players with next highest successive roll totals will take the next positions. Up to nine players may race in a single game. Three rows of three race vehicles are the preferred pole positions. The players continue the race by rolling the twelve-sided die until the race, preferably five laps of the racetrack, is completed.

After the pole positions are set, the players begin the game by rolling the twelve-sided die in their pole position order.

A player may change lanes, but may not 'leapfrog' or drive through other players' vehicles. Pit stops are required, providing a degree of realism in the present invention. A player must make a pit stop twice during a five-lap race, and cannot drive two consecutive laps without making a pit stop.

The present invention also provides a degree of realism in that a player's race vehicle will crash if the player is driving too fast (rolls too high of a number) in any one of the crash zones, which are located on the turns of the race course. When a crash occurs, the crashed race vehicle preferably blocks two of the three lanes and the remaining race vehicles slow to one half of their speed, as determined by the roll of the twelve-sided die. This provides a further degree of realism, in that trailing vehicles may now draw nearer to the leading vehicles. No lane changes are permitted when maneuvering through the racetrack curves.

The present invention provides a further degree of realism, by allowing the last place car to 'draft' by rolling the six-sided die, as well as the twelve-sided die, when driving to simulate the extra speed gain possible when utilizing the drafting technique of professional race vehicle drivers. The last place vehicle is allowed the full amount of the draft roll in a crash situation, allowing the last place vehicle to quickly draw nearer the leading vehicles.

The present invention provides a means for determining the winner of the race by providing points for pole positions, winning laps, and finish positions. The present invention further provides a means for determining the winner of a racing season by summing up the points for the individual races. The present invention accomplishes this by providing uncomplicated rules that lead to quicker games. The present invention does not utilize cards to simulate mechanical failures, strategy decisions or the like, and is thus easier to learn and quicker to play, while still providing exciting action during play. The quicker games lead to enhanced enjoyment of the game by all players involved because the players realize that misfortune in one game can be regained by a better performance in the next game or later in the racing season.

The present invention may provide toy vehicles for game play, but optionally, players may utilize their own matchbox toys or similar size toy vehicles. Thus, the present invention does not require race vehicle game pieces and allows players to use their favorite toys to play the game. This provides an opportunity for a game to be more personal, with players' own vehicles racing against each other.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1:
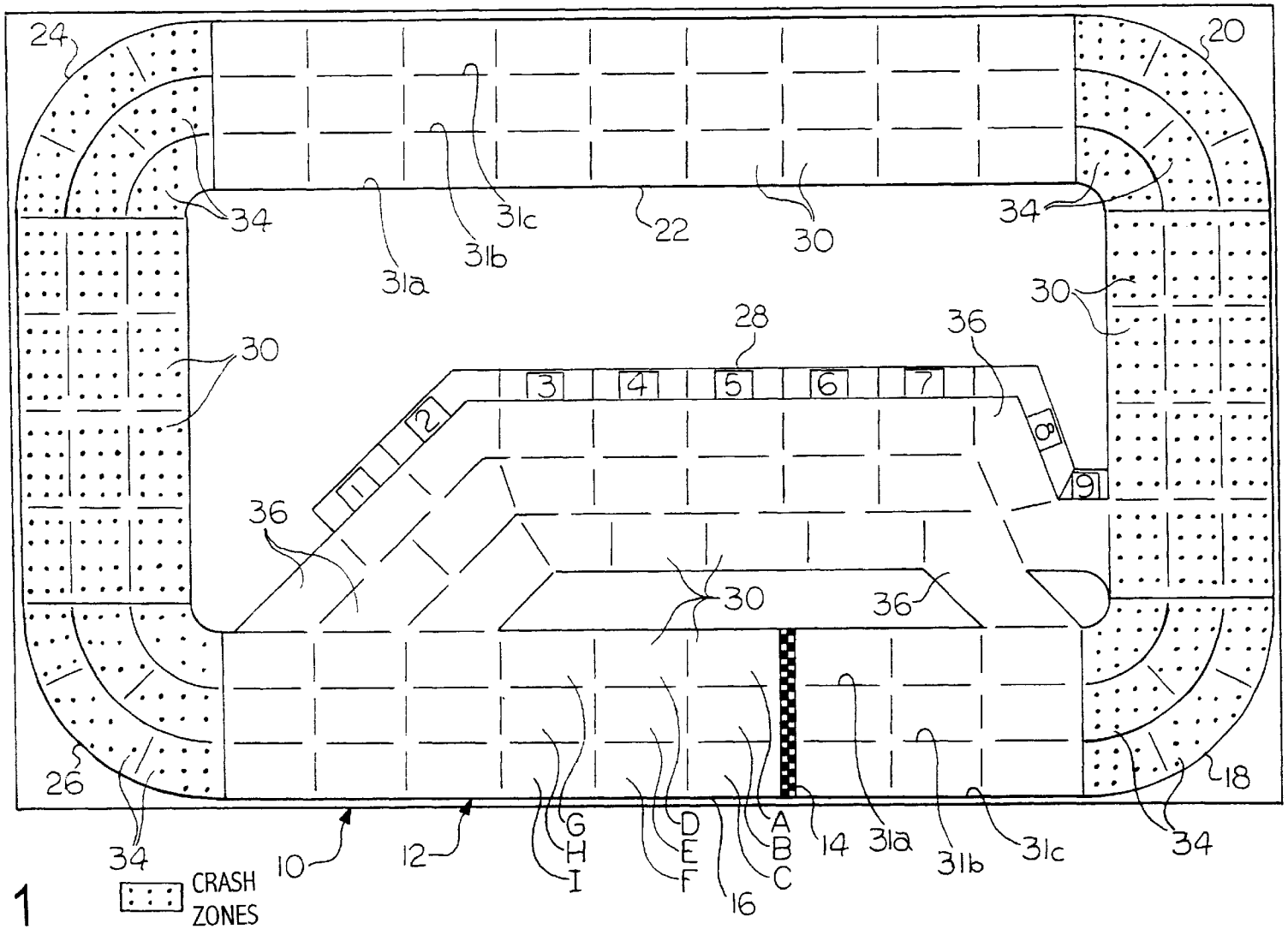
FIG. 1 is a top view of a first embodiment of a game board used for playing a race vehicle game according to this invention.

Referring now to FIG. 1, a game for entertainment is indicated generally at 10 in FIG. 1. The game simulates a vehicular race wherein miniature vehicles such as cars and trucks are used with the game board 10. Specifically, the game board 10 is sized to accommodate a popular size (1/64 scale) of toy vehicles (not shown) sold under the trademark "Matchbox." Other brands of 1/64 scale toy vehicles can also be used with the game board 10. Preferably, the other brands of toy vehicles will have a similar length and width as the Matchbox brand of toy vehicles. The toy vehicles may be provided with the game 10 or, alternatively, may be provided by the game's players (not shown.)

The game board 10 includes a racetrack 12 having a start/finish line 14 preferably marked by alternating black and white rectangles. The track 12 includes a straight section 16, a first turn 18, and second turn, 20, a backstretch 22, a third turn 24, a fourth turn 26, and a pit area 28.

A series of rectangular spaces 30 are provided on the straight section 16, the backstretch 22, and the pit area 28. Spaces 30 are also provided between the turns 18 and 20 and turns 24 and 26. The turns 18, 20, 24, and 26 include curved spaces 34. A series of transition spaces 36 are provided at the beginning and finish of the pit area 28.

Each of the rectangular spaces 30 is sized to fit one toy vehicle. For example, a preferred 1/64 scale line of toy vehicles is accommodated by spaces 30 having approximately three inches in length and approximately two inches in width. Preferably, the game board 10 of FIG. 1 includes spaces 30 of approximately three inches in length and approximately two inches in width so that the overall dimensions of the game board 10 are approximately forty-four (44) inches in length and twenty-eight (28) inches in width. Preferably, the game board 10 is divided into two equal sections and folded along a mid-line of its length.

The spaces 30 are divided into at least three circumferential lanes 31*a*, 31*b*, and 31*c*, so that a player can pass the other players during a game described below. For clarification, lane 31*a* will be referred to as the inside lane, lane 31*b* will be referred to as the middle lane, and lane 31*c* will be referred to as the outside lane. In turns, 18, 20, 24, and 26, there is only one curved space 34 in the inside lane 31*a*, while there are two curved spaces 34 in the middle lane 31*b*, and three curved spaces 34 in the outside lane 31*c*. This provides an advantage to those players in the inside lane 31*a*, in that a player can use less spaces to complete one lap of racetrack 12.

A game played with game board 10 is described below. The game is intended for play of two to nine players (not shown.) The game preferably includes the game board 10, a twenty-sided die (not shown), a twelve-sided die (not shown), a six-sided die (not shown), and markers (not shown) for identifying name and lap for use with the game board 10. The game optionally includes toy race vehicles (not shown.)

The game starts by the players twice rolling all three dice (not shown) to determine their respective qualifying, or starting, positions A through I. The roll totals may be recorded on a qualifying sheet (not shown.) The player with the highest roll total receives the first, or pole, position A. The player with the second highest roll total receives the second starting position B. The player with the third highest roll total receives the third starting position C, the player with the fourth highest roll total receives the fourth starting position D, and so on, until the player with the ninth highest roll total receives the ninth starting position I. Race vehicles (not shown) are then placed in their respective starting positions A through I. Although only nine players may compete in a given race, up to twelve players may attempt to qualify for a race.

After the pole positions A through I are set, the players begin the game by rolling the twelve-sided die in their pole position order and move the toy vehicles in a counterclockwise direction around the racetrack 12. The toy vehicles are moved the number of spaces 30 equal to the roll of the die. The players continue the game by rolling the twelve-sided die until all players finish the race, preferably five laps of the racetrack 12. A player completes a lap when the player has completely crossed the start/finish line 14, but not counting the first time the player crosses the start/finish line 14 at the beginning of the race. Players may move into adjacent spaces 30 only and may not move backwards, or in a clockwise direction around the racetrack 12. A player may change lanes 31*a* to 31*b,* to 31*c,* but may not 'leapfrog' other players' vehicles. No lane changes, however, are permitted when the player is located in any of the spaces 34 in curves 18, 20, 22, and 24. Stopping in the pit area 28, referred to as making a "pit stop", is required. A player must make a pit stop twice during a five-lap race, and cannot drive two consecutive laps without making a pit stop. The pit area 28 has numbers that preferably correspond to the player's starting position. A player must stop in the appropriate space in the pit area 28 before continuing out to the racetrack 12 via the transition spaces 36.

A player's toy vehicle will crash if the player is driving too fast (rolls the highest number on the die) in any one of the crash zones, indicated by shaded spaces 30 and 34 on the racetrack 12. The crash zones are located in all of spaces 34 in the turns 18, 20, 24, and 26 and in the spaces 30 provided between the turns 18 and 20 and turns 24 and 26. Alternatively, crash zones may be placed at other locations along the racetrack 12. A player may avoid crashing by making an emergency pit stop if he or she can advance the required number of spaces 30 to the pit area 28 with the roll. If not, the toy vehicle moves the number of spaces 30 and crashes at that spot. When a crash occurs, the crashed race vehicle preferably blocks two of the three lanes 31*a,* 31*b,* or 31*c,* and the remaining race vehicles slow to one half of their speed, as determined by the roll of the twelve-sided die, rounding up in the case of odd numbers. The crashed vehicle is removed when it becomes the crashed player's turn to roll, and the remaining players resume normal speed after the crashed vehicle is removed.

The last place vehicle, the toy vehicle in the farthest position in the outermost lane, is allowed to 'draft' by rolling the six-sided die, as well as the twelve-sided die, when it is the last place player's turn to roll. This simulates the extra speed gain possible when utilizing the drafting technique of professional race vehicle drivers. In addition, the last place vehicle is allowed the full amount of the draft roll in a crash situation, providing a further way for the last place vehicle to draw nearer to the rest of the field during a crash situation.

Alternatively, the players may use the twenty-sided die to advance around the racetrack 12. The twenty-sided die is preferably used when a physically larger track is utilized, for example racetrack 200 noted below. The use of a twenty-sided die will assist in keeping the game moving at its preferred quick pace.

The present invention provides a means for awarding points to the players by providing points for obtaining the pole position, for winning individual laps, and for the final race placing positions. The present invention further provides a means for determining the winner of a racing season by summing up the awarded points for the individual races. Points may be tallied on a point standings card (not shown) and are awarded according to the following table:

| Placing in Race | Points | Notes |
|---|---|---|
| 1st Place | 20 points | |
| 2nd Place | 16 points | |
| 3rd Place | 14 points | |
| 4th Place | 12 points | |
| 5th Place | 10 points | |
| 6th Place | 8 points | |
| 7th Place | 6 points | |
| 8th Place | 5 points | |
| 9th Place | 4 points | |
| 10th Place | 3 points | Non-qualifying cars still win points even though they don't race |
| 11th Place | 2 points | See 10th Place Notes |
| 12th Place | 1 point | See 10th Place Notes |
| Bonus Points | | |
| Winning pole | 1 point | |
| Leading a lap | 1 point | |

The player amassing the most total points at the end of a ten-race season is declared the season champion.

Figure 2:
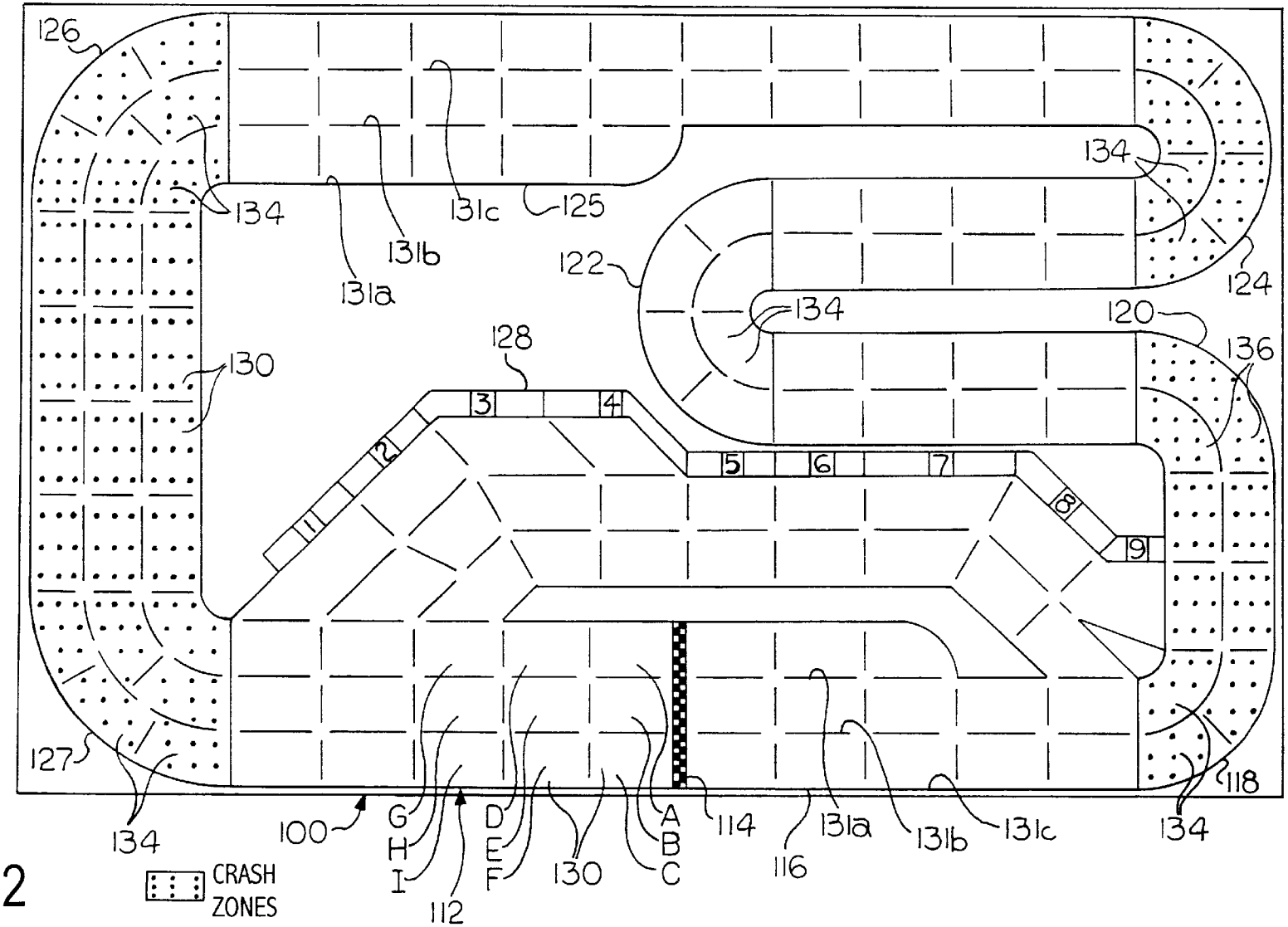
FIG. 2 is a top view of a second embodiment of a game board used for playing a race vehicle game according to this invention.

A second embodiment of a game board according to this invention is indicated generally at 100 in FIG. 2. The game board 100 includes a racetrack 112 having a start/finish line 114 preferably marked by alternating black and white rectangles. The racetrack 112 includes a straight section 116, a first turn 118, a second turn 120, a third turn (180 degrees) 122, a fourth turn (180 degrees) 124, a backstretch 125, a fifth turn 126, a sixth turn 127, a pit area 128, and starting positions A through I. The racetrack 112 also includes crash zones indicated by shaded spaces 130 and 134 on the racetrack 112.

As in game board 10, the spaces 130 are divided into at least three circumferential lanes 131*a,* 131*b,* and 131*c,* so that a player can pass the other players during the game described above. Similarly, lane 131*a* will be referred to as the inside lane, lane 131*b* will be referred to as the middle lane, and lane 131*c* will be referred to as the outside lane. Lanes 131*a,* 131*b,* and 131*c* are provided in the straight section 116. The racetrack 112 narrows to lanes 131*b* and 131*c* through the first, second, third, and fourth turns 118, 120, 122, and 124. The racetrack 112 expands back to lanes 131*a,* 131*b,* and 131*c* on the backstretch 125 and continues until the start/finish line 114. Also as in game board 10, the number of spaces 134 in turns 118, 120, 122, and 124 is the greatest in outside lane 131*c*. Similarly, the number of spaces 134 in middle lane 131*b* is greater than the number of spaces 134 in inside lane 131*a,* but less than outside lane 131*c*.

When spaces 130 are approximately three inches in length and two inches in width, the game board 100 is approximately forty-four inches in length and twenty-eight inches in width. Preferably, the game board 100 is divided into two equal sections and folded along a mid-line of its length.

The game board 100 can also be played according to the game rules as outlined above.

Figure 3:
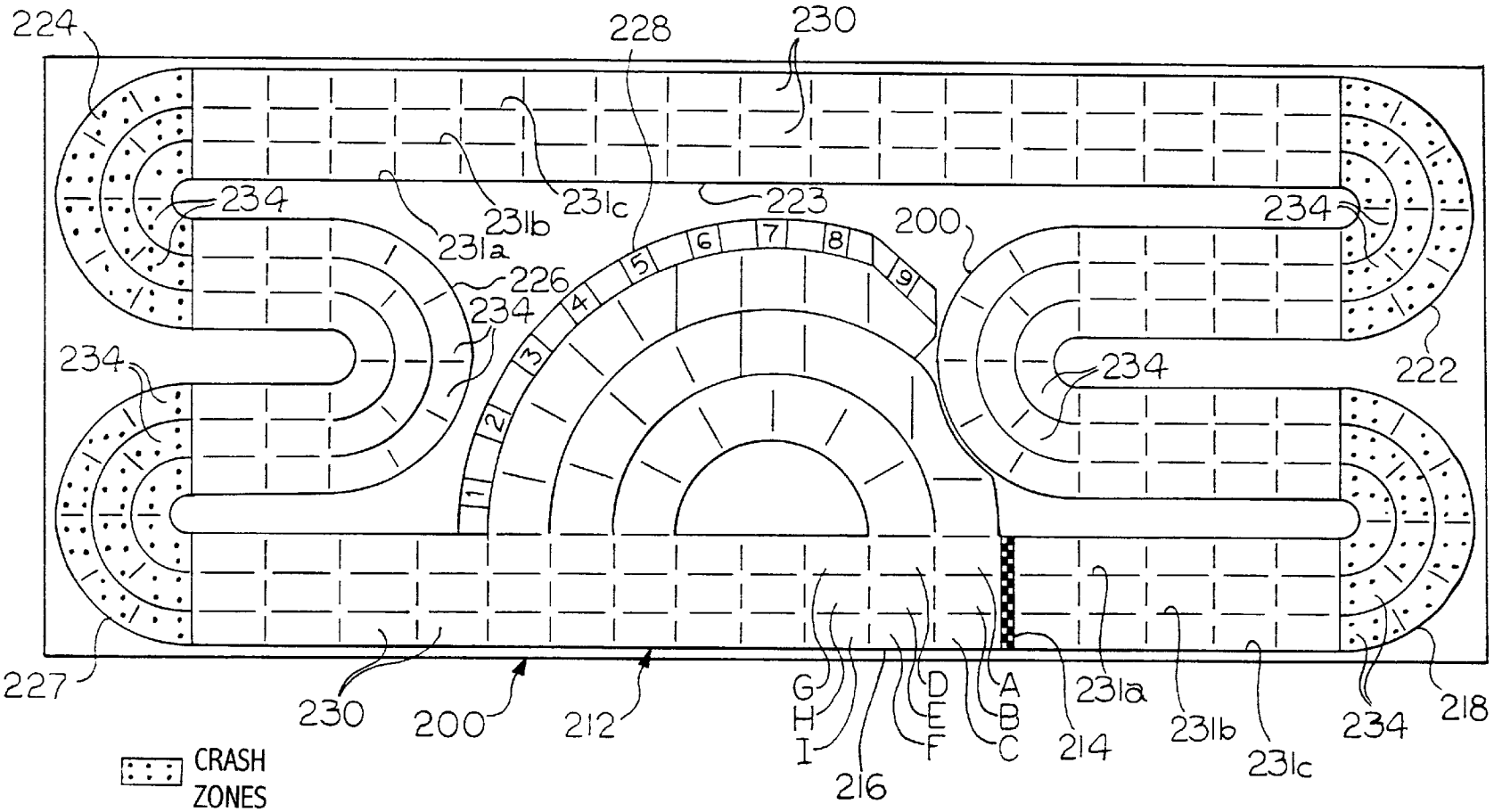
FIG. 3 is a top view of a third embodiment of a game board used for playing a race vehicle game according to this invention.

A third embodiment of a game board according to this invention is indicated generally at 200 in FIG. 3. The game board 200 includes a racetrack 212 having a start/finish line 214 preferably marked by alternating black and white rectangles. The track 212 includes a straight section 216, a first turn (180 degrees) 218, a second turn (180 degrees) 220, a third turn (180 degrees) 222, a backstretch 223, a fourth turn (180 degrees) 224, a fifth turn (180 degrees) 226, a sixth turn (180 degrees) 227, a pit area 228, and starting positions A through I. The racetrack 212 also includes crash zones indicated by shaded spaces 230 and 234 on the racetrack 212.

As in game boards 10 and 100, the spaces 230 are divided into at least three circumferential lanes 231*a,* 231*b,* and 231*c,* so that a player can pass the other players during the game described above. Similarly, lane 231*a* will be referred to as the inside lane, lane 231*b* will be referred to as the middle lane, and lane 231*c* will be referred to as the outside lane. Lanes 231*a,* 231*b,* and 231*c* are provided in the straight section 216, in backstretch 223, and in each of turns 218, 220, 222, 223, 224, 226, and 227. Also as in game boards 10 and 100, the number of spaces 234 in turns 218, 220, 222, 223, 224, 226, and 227 is the greatest in outside lane 131*c*. Similarly, the number of spaces 234 in middle lane 231*b* is greater than the number of spaces 234 in inside lane 231*a,* but less than outside lane 231*c*.

When spaces 230 are approximately three inches in length and two inches in width, the game board 200 is approximately sixty-six inches in length and twenty-eight inches in width. Preferably, the game board 200 is divided into equal third along its length for folding and easy storage.

The game board 200 can also be played according to the game rules as outlined above.

Alternatively, the game boards 10 or 100 may be printed with racetracks 12 or 112 on opposing planar sides of the game board 10 or 100, as they are contemplated to be approximately the same size. Similarly, game board 200 may be printed with racetrack 212 and a similar-sized racetrack with a different configuration on opposing planar sides of the game board 200. In this way, players in the game could race on alternating courses through the length of the season, adding another element to the games, and increasing the enjoyment of the players.

In accordance with the provisions of the patent statutes, the present invention has been described in what is considered to represent its preferred embodiment. However, it should be noted that the invention can be practiced otherwise than as specifically illustrated and described without departing from its spirit or scope. For example, other tracks and variations may be designed for the game boards 10, 100, and 200. Other rules, scoring means and variations may be designed for use with the games described above.

What is claimed is:

1. A method of playing a vehicle racing board game comprising the steps of:

a. providing a board having a game playing surface displaying a racetrack, the racetrack including at least two contiguous lanes each extending in a closed loop and a start/finish line extending transversely across the lanes, each of the lanes containing a plurality of separate spaces, at least two of the spaces being designated as starting positions including a pole position and at least one other of the spaces designated as a crash zone;

b. providing at least two playing pieces representing vehicles each sized to fit within the spaces and adapted to be moved along the lanes in a predetermined direction by an associated player;

c. providing a chance means usable by the players for generating random numbers;

d. the players using the chance means to determine which of the playing pieces is placed in which of the starting positions thereby setting an order of play;

e. the players using the chance means to determine a number of the spaces to move the playing pieces in a predetermined direction around the racetrack;

f. moving the playing pieces around the racetrack a predetermined number of laps to complete a race;

g. awarding points to each of the players who start from the pole position, win a lap of said racetrack, and complete a race based upon a finishing position;

h. repeating steps d. through g. for a predetermined number of completed races to determine a champion based upon a total of the points awarded; and i. providing a crash zone and including requiring placing one of the playing pieces across at least one of said lanes when step e. generates a maximum number and the playing piece is in the crash zone.

2. The method according to claim 1 wherein the racetrack includes a pit area connected to the lanes and including requiring the playing pieces to stop in the pit area at least once during each of the races.

* * * * *